US009858894B2

(12) United States Patent
Kim

(10) Patent No.: US 9,858,894 B2
(45) Date of Patent: Jan. 2, 2018

(54) DISPLAY DEVICE AND METHOD OF DRIVING A DISPLAY DEVICE

(71) Applicant: SAMSUNG DISPLAY CO., LTD., Yongin-si, Gyeonggi-do (KR)

(72) Inventor: Hun-Bae Kim, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/087,648

(22) Filed: Mar. 31, 2016

(65) Prior Publication Data

US 2016/0314761 A1 Oct. 27, 2016

(30) Foreign Application Priority Data

Apr. 21, 2015 (KR) ..... 10-2015-0055722

(51) Int. Cl.
*G09G 5/10* (2006.01)

(52) U.S. Cl.
CPC ..... *G09G 5/10* (2013.01); *G09G 2320/0276* (2013.01); *G09G 2320/0673* (2013.01); *G09G 2330/021* (2013.01)

(58) Field of Classification Search
CPC ..... H02M 3/1582; H02M 2001/009; H02M 3/158; G09G 2330/021; G09G 2320/0276; G09G 5/10
See application file for complete search history.

(56) References Cited

U.S. PATENT DOCUMENTS

2006/0044227 A1* 3/2006 Hadcock ..... G09G 3/3225 345/76
2009/0174634 A1* 7/2009 Kohno ..... G09G 3/3233 345/84
2011/0298782 A1* 12/2011 Park ..... G09G 3/3225 345/212
2012/0062613 A1* 3/2012 Park ..... G09G 3/3233 345/690
2012/0242710 A1* 9/2012 Kang ..... G09G 3/3208 345/690
2013/0127923 A1* 5/2013 An ..... G09G 5/10 345/690
2013/0321485 A1* 12/2013 Eom ..... G09G 3/3208 345/690

FOREIGN PATENT DOCUMENTS

KR 10-2006-0012738 A 2/2006
KR 10-2006-0017202 A 2/2006
KR 10-2011-0123983 A 11/2011
KR 10-2012-0114989 A 10/2012
KR 10-2014-0028860 A 3/2014

* cited by examiner

*Primary Examiner* — Yuzhen Shen
(74) *Attorney, Agent, or Firm* — Lewis Roca Rothgerber Christie LLP

(57) ABSTRACT

A method of driving a display device includes: calculating a reference luminance corresponding to a light emission intensity and an off-duty ratio corresponding to a non-emission time based on image data; and adjusting at least one selected from a first power voltage and a second power voltage to drive a display panel based on the reference luminance and the off-duty ratio.

18 Claims, 8 Drawing Sheets

DISPLAY DEVICE AND METHOD OF DRIVING A DISPLAY DEVICE

CROSS-REFERENCE TO RELATED APPLICATION

This application claims priority to and the benefit of Korean Patent Application No. 10-2015-0055722, filed on Apr. 21, 2015 in the Korean Intellectual Property Office (KIPO), the content of which is incorporated herein in its entirety by reference.

BACKGROUND

1. Field

Example embodiments of the present invention relate to a display device and a method of driving a display device.

2. Description of the Related Art

Generally, an organic light emitting display device displays an image using an organic light emitting diode that emits light based on recombination of electrons and holes. A related art light emitting device and a method of performing gamma correction thereof may enable a user to select a fine gamma correction method in a sensor mode or in a user mode and arbitrarily adjust a display luminance. However, when the light emitting device performs a luminance control, a grayscale inversion phenomenon may occur in some ranges (e.g., a low luminance range). That is, the gamma characteristics may be deteriorated as the luminance control is performed.

The above information disclosed in this Background section is only for enhancement of understanding of the background of the invention and therefore it may contain information that does not constitute prior art.

SUMMARY

Aspects of example embodiments of the present invention relate to a display device and a method of driving a display device, in which gamma characteristics may be improved.

According to some example embodiments, a display device may be capable of improving gamma characteristics (or, a gamma property) in a low luminance range.

Aspects of some example embodiments relate to a method of driving the display device.

According to some example embodiments of the present invention, in a method of driving a display device, the method includes: calculating a reference luminance corresponding to a light emission intensity and an off-duty ratio corresponding to a non-emission time based on image data; and adjusting at least one selected from a first power voltage and a second power voltage to drive a display panel based on the reference luminance and the off-duty ratio.

The off-duty ratio may be an occupying ratio of the non-emission time in an emission period.

The reference luminance may be proportional to a luminance of the image data and may be inversely proportional to an on-duty ratio of the image data, and a sum of the on-duty ratio and the off-duty ratio may be constant.

Calculating the reference luminance and the off-duty ratio may include: calculating an on-pixel ratio representing a ratio of a number of active pixels in an on-state to a total number of pixels in a unit frame; and obtaining the reference luminance and the off-duty ratio based on the on-pixel ratio.

The reference luminance and the off-duty ratio may be obtained from a first look-up table, and the first look-up table may include the reference luminance and the off-duty ratio that are determined based on a luminance level of the image data.

The first look-up table may include at least one range in which the off-duty ratio increases as the luminance level of the image data decreases.

Adjusting the at least one selected from the first power voltage and the second power voltage may include: calculating a variable voltage difference between the first power voltage and the second power voltage based on the reference luminance; determining whether or not the off-duty ratio is within a predetermined range; selecting one from a reference voltage difference and the variable voltage difference based on a determination result; and generating a power voltage control signal based on the one from the reference voltage difference and the variable voltage difference.

Selecting the one from the reference voltage difference and the variable voltage difference may include: selecting the variable voltage difference in response to the off-duty ratio being within the predetermined range; and selecting the reference voltage difference in response to the off-duty ratio being out of the predetermined range.

The variable voltage difference may be obtained from a second look-up table, and the second look-up table may include an information of the second power voltage that is determined based on the reference luminance.

Adjusting the at least one selected from the first power voltage and the second power voltage may further include: adjusting a level of the second power voltage in response to the power voltage control signal.

According to some example embodiments of the present invention, in a method of driving a display device, the method includes: generating modulated image data by reducing a grayscale of image data; calculating a reference luminance corresponding to a light emission intensity and an off-duty ratio corresponding to a non-emission time based on the modulated image data; and adjusting at least one selected from a first power voltage and a second power voltage to drive a display panel based on the reference luminance and the off-duty ratio.

Generating the modulated image data may include: calculating an on-pixel ratio representing a ratio of a number of active pixels in an on-state to a total number of pixels in a unit frame; and reducing the grayscale of the image data based on the on-pixel ratio.

Reducing the grayscale of the image data may include: determining whether or not the on-pixel ratio is out of a reference on-pixel ratio; and reducing the grayscale of the image data in proportion to the on-pixel ratio in response to the on-pixel ratio being out of the reference on-pixel ratio.

Calculating the reference luminance and the off-duty ratio may include: obtaining the reference luminance and the off-duty ratio based on the on-pixel ratio.

The reference luminance and the off-duty ratio may be obtained from a first look-up table, and the first look-up table may include the reference luminance and the off-duty ratio that are determined based on a luminance level of the modulated image data.

The first look-up table may include at least one range in which the off-duty ratio increases as the luminance level of the modulated image decreases.

Adjusting at least one selected from the first power voltage and the second power voltage may include: calculating a variable voltage difference between the first power voltage and the second power voltage based on the reference luminance; determining whether or not the off-duty ratio is within a predetermined range; selecting one from a reference voltage difference and the variable voltage difference based on a determination result; and generating a power voltage control signal based on the one from the reference voltage difference and the variable voltage difference.

Selecting the one from the reference voltage difference and the variable voltage difference may include: selecting the variable voltage difference in response to the off-duty ratio being within the predetermined range; and selecting the reference voltage difference in response to the off-duty ratio being out of the predetermined range.

Adjusting the at least one selected from the first power voltage and the second power voltage may further include: adjusting a level of the second power voltage in response to the power voltage control signal.

According to some example embodiments of the present invention, a display device includes: a display panel including a plurality of pixels; a signal controller configured to calculate a reference luminance corresponding to a light emission intensity and an off-duty ratio corresponding to a non-emission time based on image data and configured to generate a power voltage control signal based on the reference luminance and the off-duty ratio; and a power supplier configured to adjust at least one selected from a first power voltage and a second power voltage to drive the display panel in response to the power voltage control signal.

Therefore, a display device according to some example embodiments may improve gamma characteristics in some luminance ranges as well as may reduce power consumption by calculating a reference luminance and an off-duty ratio of image data and by changing a power voltage supplied to a pixel based on the reference luminance and the off-duty ratio. In addition, the display device may alternatively use a function to change the power voltage in some luminance ranges based on the off-duty ratio.

In addition, a method of driving a display device may efficiently drive the display device.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
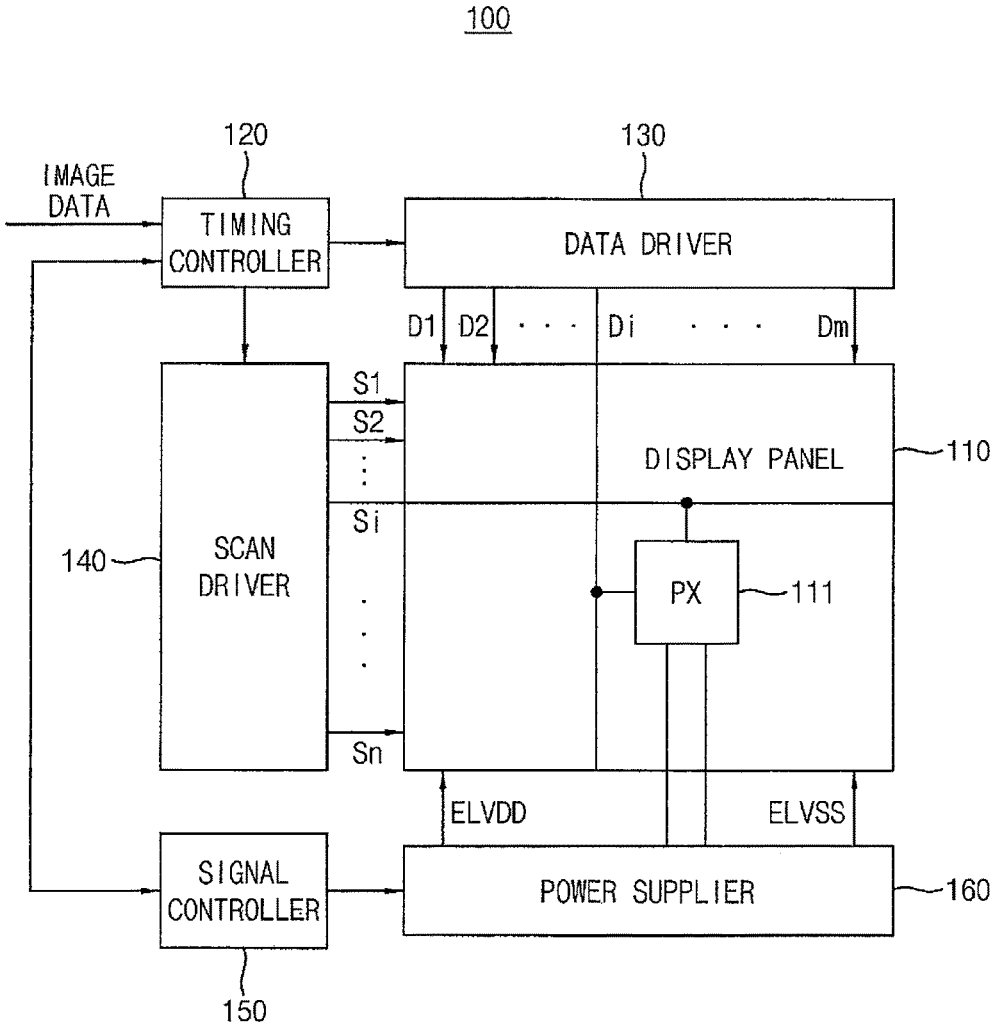
FIG. 1 is a block diagram illustrating a display device according to some example embodiments of the present invention.

Hereinafter, aspects of some embodiments of the present invention will be explained in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to some example embodiments.

Referring to FIG. 1, the display device 100 may include a display panel 110, a timing controller 120, a data driver 130, a scan driver 140, a signal controller 150, and a power supplier 160. For example, the display device 100 may be an organic light emitting display device.

The display panel 110 may include a plurality of pixels 111 arranged or positioned at intersections of scan lines S1 through Sn and data lines D1 through Dm, where n and m are integers greater than or equal to 2. Each of the pixels 111 may include a light emitting element. For example, the light emitting element may be an organic light emitting diode.

Each of the pixels 111 may store a data signal supplied through the data lines D1 through Dm in response to a scan signal supplied through the scan lines S1 through Sn. Each of the pixels 111 may emit light in response to the data signal. Each of the pixels 111 may control a current flowing through the organic light emitting diode in response to the data signal. The organic light emitting diode may represent a grayscale by emitting light during an emission time in response to the data signal.

The timing controller 120 may provide image data to the data driver 130. The timing controller 120 may generate a data driving control signal to provide the data driving control signal to the data driver 130. The timing controller 120 may generate a scan control signal to provide the scan control signal to the scan driver 140. In addition, the timing controller 120 may provide the image data to the signal controller 150. Here, the image data may include a grayscale of an input image.

In some example embodiments, the data driver 130 may have a gamma voltage generating circuit that generates a plurality of grayscale voltages based on a gamma curve. That is, the gamma voltage generating circuit may generate a plurality of gamma reference voltages that have fixed voltages and may generate the grayscale voltages corresponding to grayscales of the image data based on the gamma reference voltages.

The scan driver 140 may generate a scan signal based on the scan driving control signal and may provide the pixels 111 with the scan signal through the scan lines S1 through Sn. The scan driving control signal may include a start pulse and a clock pulse. The scan driver 140 may include a shift register that sequentially generates the scan signal based on the start pulse and the clock pulse.

The signal controller 150 may generate modulated image data based on the image data provided from the timing controller 120 and may provide the modulated image data to the timing controller 120. Here, the modulated image data may include a grayscale obtained by deducting (or, reducing) a grayscale of the image data.

The signal controller 150 may limit a driving current of the pixels 111 based on the image data. When image data of a frame is to illuminate the whole screen with a high luminance, the signal controller 150 may limit the driving current of the pixels 111 to reduce luminance of the whole screen. For example, the signal controller 150 may calculate an on-pixel ratio (OPR) of the image data of the frame. Here, the on-pixel ratio may represent a ratio of a number of active pixels in an on-state to a total number of pixels in the frame (e.g., a unit frame). The signal controller 150 may modulate the image data of the frame based on the on-pixel ratio. For example, the signal controller 150 may calculate an average luminance by summing the grayscales of the image data in the frame and may adjust the image data (or, a data signal generated by the data driver 130) based on the average luminance.

Therefore, the display device 100 may reduce a data voltage provided to the pixels 111 by using the modulated image data rather than a data voltage (e.g., data signal) provided to the pixels 111 according to original image data (e.g., image data prior to modulation) and may reduce an amount of a current flowing through the pixel 111 according to a reduced data voltage. Therefore, the display device 100 may reduce power consumption.

The signal controller 150 may calculate a reference luminance and an off-duty ratio based on the image data and may generate a power voltage control signal to adjust at least one selected from a first power voltage ELVDD and a second power voltage ELVSS based on the reference luminance and the off-duty ratio. Here, the reference luminance may correspond to a light emission intensity, the off-duty ratio may correspond to a non-emission time (or, black period), and the off-duty ratio may be an occupying ratio of the non-emission time in an emission period (e.g., the off-duty ratio=the non-emission time/the emission period). For example, if the emission period is 10 ms and the non-emission time is 4 ms, the off-duty ratio may be 40 percent (%). The reference luminance may be set to be proportional to luminance (or, a luminance level) of the image data. The reference luminance may be set to be inversely proportional to an on-duty ratio of the image data. Here, the on-duty ratio may be an occupying ratio of the emission time in the emission period (i.e., the on-duty ratio=the emission time/the emission period). A sum of the on-duty ratio and the off-duty ratio is constant. The reference luminance and the off-duty ratio will be described in detail with reference to FIGS. 2A and 2B, and a specific configuration for generating the power voltage control signal will be described in detail with reference to FIG. 3.

The power supplier 160 may generate the first power voltage ELVDD and the second power voltage ELVSS based on the power voltage control signal generated by the signal controller 150. The first power voltage ELVDD and the second power voltage ELVSS may be power voltages to drive each of the pixels 111. The first power voltage ELVDD may have a voltage level higher than that of the second power voltage ELVSS. The power supplier 160 may supply the display panel 110 with the power voltages ELVDD and ELVSS through a first power line and a second power line. The power supplier 160 may include a DC-DC converter.

The display device 100 may generate the modulated image data based on the image data, may reduce the data voltage based on the modulated image data, may calculate the reference luminance and the off-duty ratio based on the image data, and may change the first power voltage ELVDD or the second power voltage ELVSS based on the reference luminance and the off-duty ratio. Therefore, the display device 100 may reduce power consumption. In addition, the display device 100 may alternatively use a function of changing the first power voltage ELVDD or the second power voltage ELVSS based on whether the off-duty ratio is within a specified range. Therefore, the display device 100 may improve gamma characteristics in a certain range (e.g., a low luminance range).

Before describing a specific configuration of the signal controller 150, a smart dimming driving technique employed (or, used) in the display device 100 of FIG. 1 will be described with respect to the reference luminance and the off-duty ratio that are calculated by the signal controller 150.

Figure 2A:
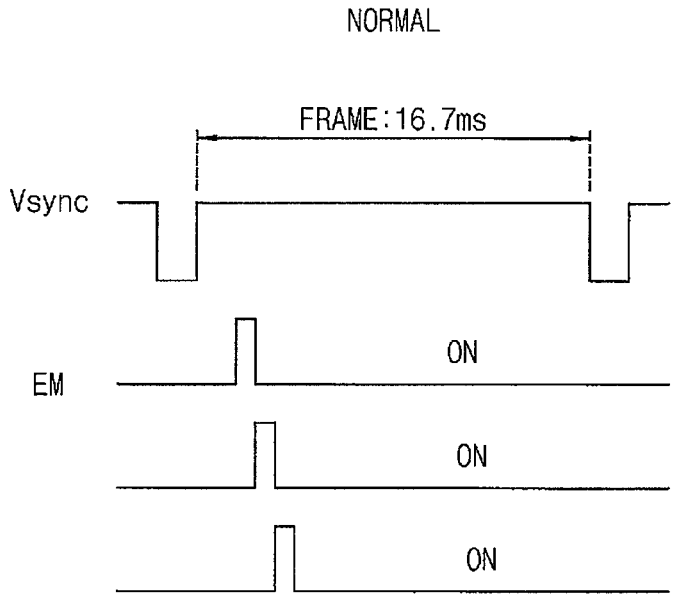
FIGS. 2A and 2B are waveform diagrams for describing a smart dimming driving technique used in the display device of FIG. 1.
Figure 2A:
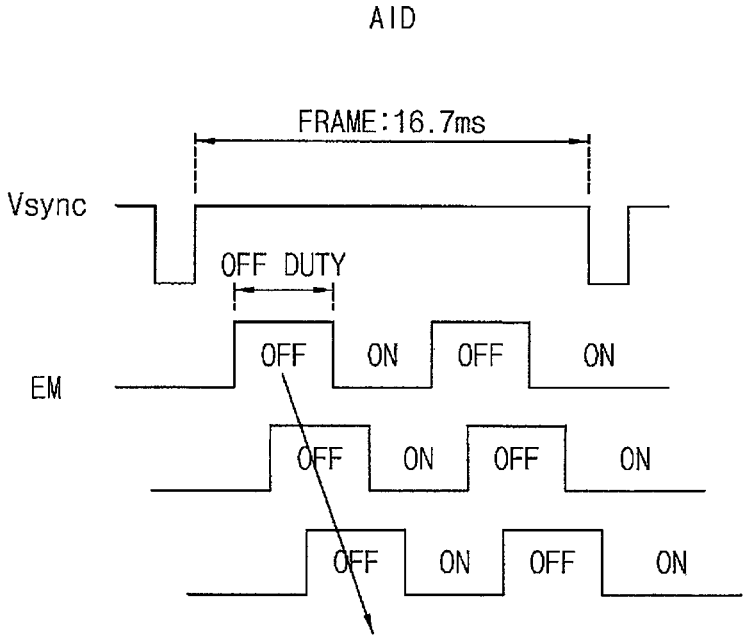
Figure 2B:
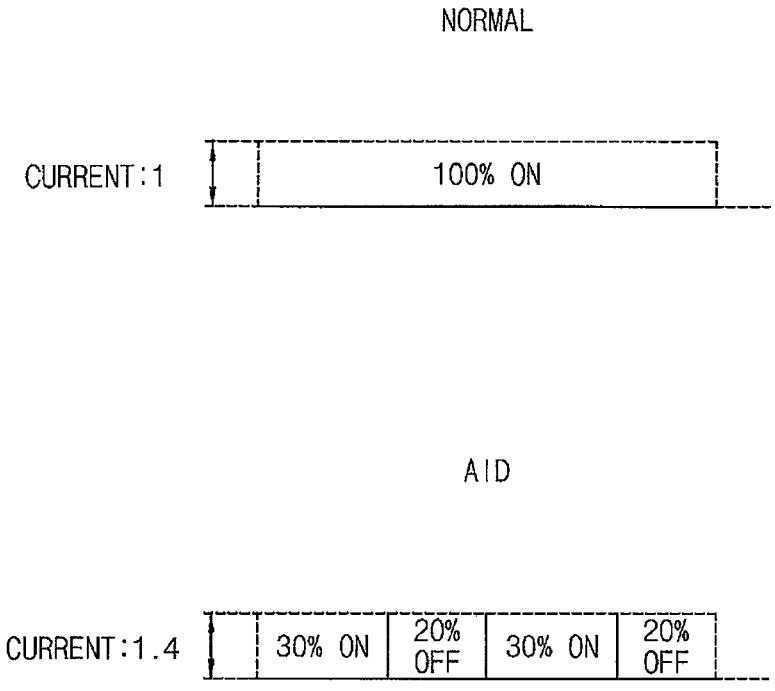

FIGS. 2A and 2B are waveform diagrams for explaining a smart dimming driving technique used in the display device of FIG. 1. To solve a problem due to a decrease of a driving current in a low luminance range (e.g., a mura phenomenon of the display panel 100 due to a current deviation in the pixels 111), the smart dimming driving technique (or, an OLED impulsive driving) may increase an amount of the driving current in an emission period and may insert a non-emission time (or, a black period) in the emission period based on the amount of increased driving current.

Referring to FIG. 2A, in a normal driving of the display device 100, a light emitting control signal EM is in an on-state during a frame FRAME, and a relative amount of the driving current may be represented as 1. Here, the light emitting control signal EM may control emission or non-emission of a pixel (e.g., a light emitting element in the pixel).

In the smart dimming driving technique, the light emitting control signal EM may include an on-duty ON (or, an emission time) and an off-duty OFF (or, a non-emission time) that appear repeatedly in the frame FRAME. For example, an off-duty ratio may be 40 percent (%). Here, the relative amount of the driving current may be larger than that of the driving current in the normal driving corresponding to the off-duty ratio. For example, the relative amount of the driving current in the smart dimming driving technique may be 1.4 that is 1.4 times larger than that of the driving current in the normal driving.

Because the smart dimming driving technique may increase the driving current of a pixel (e.g., by changing the driving current according to adjustment of off-duty ratio), power consumption of the display device 100 may be increased when the smart dimming driving technique is applied in a high luminance range. Therefore, the smart dimming driving technique may be applied to a middle luminance range and/or a low luminance range. The high luminance range, the middle luminance range, and the low luminance range will be described with reference to TABLE I, below.

TABLE I

| | Luminance step | Reference luminance | Off-duty ratio |
|---|---|---|---|
| High luminance range | 300 | 300 | 0 |
| | 290 | 290 | 0 |
| | 280 | 280 | 0 |
| | . . . | . . . | . . . |
| | 190 | 190 | 0 |
| Middle luminance range | 180 | 300 | 40% |
| | 170 | 284 | 40% |
| | . . . | . . . | . . . |
| | 120 | 200 | 40% |
| | 110 | 184 | 40% |
| Low luminance range | 100 | 100 | 0% |
| | 90 | 100 | 10% |
| | 80 | 100 | 20% |
| | 70 | 100 | 30% |
| | 30 | 100 | 70% |
| | 20 | 100 | 80% |

TABLE I represents a set value that is set by a luminance step for the smart dimming driving technique.

As shown in TABLE I, luminance steps may be divide into the high luminance range (e.g., a range in which no off-duty ratio is applied), the middle luminance range (e.g., a fixed off-duty range in which the off-duty ratio is fixed to 40%), and the low luminance range (e.g., a variable off-duty range) based on maximum luminance 300 cd/m2. The luminance steps may be luminance levels or brightness levels to be represented according to the image data in the display device 100.

The high luminance range may include luminance steps 300 cd/m2 through 190 cd/m2. The high luminance range may include a reference luminance corresponding to a specific luminance step. The off-duty ratio may be 0 in the high luminance range.

The middle luminance range may include luminance steps 180 cd/m2 through 110 cd/m2. The off-duty ratio may be fixed to 40% in the middle luminance range. Because the off-duty ratio is fixed to 40%, a reference luminance may have a value higher than that of a luminance step corresponding to the reference luminance (e.g., a value of the luminance step). For example, when the luminance step is 180 cd/m2, the reference luminance may be set to be 300 cd/m2. That is, the reference luminance may be 300 cd/m2 to represent a luminance of 180 cd/m2 when the off-duty ratio is 40%.

The low luminance range may include luminance steps 100 cd/m2 through 20 cd/m2. The reference luminance may be set to have a constant value. For example, the reference luminance may be 100 cd/m2. As the luminance step is lower, the off-duty ratio may be set to be larger in the low luminance range.

The display device 100 may employ (or, use) the smart dimming driving technique. Therefore, the display device 100 may have luminance characteristics of a luminance step 100 cd/m2 in the low luminance range (e.g., luminance steps 100 cd/m2 through 20 cd/m2).

Figure 3:
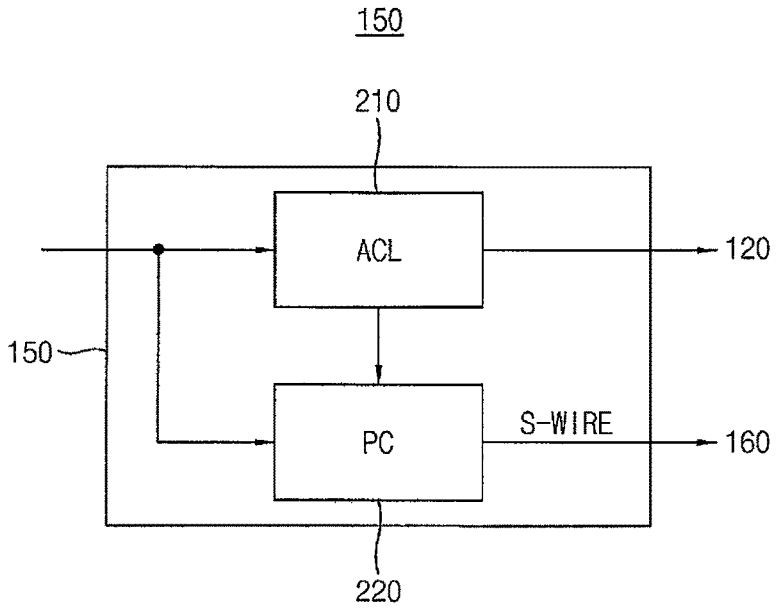
FIG. 3 is a block diagram illustrating a signal controller included in the display device of FIG. 1.

FIG. 3 is a block diagram illustrating a signal controller included in the display device of FIG. 1.

Referring to FIG. 3, the signal controller 150 may include an automatic current limit (ACL) unit 210 and a power control unit 220.

The automatic current limit unit 210 may modulate image data to generate modulated image data. In an example embodiment, the automatic current limit unit 210 may calculate an on-pixel ratio of the image data of a certain frame and may generate the modulated image data by reducing (or, deducting) the image data of the certain frame based on the on-pixel ratio. Here, the on-pixel ratio may be a ratio of a number of active pixels in an on-state to a total number of pixels in a unit frame. For example, the on-pixel ratio may be a ratio of a number of sub-pixels that is activated to be in an on-state to a total number of sub-pixels that emit light with a red color, a green color, and a blue color in a frame.

In an example embodiment, the automatic current limit unit 210 may determine whether each of sub-pixels is turned on or turned off based on the image data (i.e., grayscales of the image data). The automatic current limit unit 210 may calculate a first on-pixel ratio of red color image data, a second on-pixel ratio of green color image data, and a third on-pixel ratio of blue color image data based on the determination result (i.e., whether each of sub-pixels is turned on or turned off), respectively. Here, the red color image data, the green color image data, and the blue color image data may be included in the image data. The automatic current limit unit 210 may obtain an on-pixel ratio of whole pixels by summing calculated on-pixel ratios (e.g., the first through the third on-pixel ratios).

In an example embodiment, the automatic current limit unit 210 may reduce (or, deduct) the image data when an on-pixel ratio of image data in a certain frame is out of a predetermined value. For example, the automatic current limit unit 210 may determine that luminance of the image data is relatively high when the on-pixel ratio of the image data in the certain frame is out of the predetermined value. The automatic current limit unit 210 may deduct the image data by collectively reducing grayscales of the image data by a predetermined size or with a predetermined ratio.

In another example embodiment, the automatic current limit unit 210 may determine that luminance of the image data is not relatively high when the on-pixel ratio is within the predetermined value. In this case, the automatic current limit unit 210 may not deduct the image data.

The power control unit 220 may calculate the reference luminance and the off-duty ratio by analyzing the image data or the modulated image data. The power control unit 220 may generate the power voltage control signal to adjust at least one selected from the first power voltage ELVDD and the second power voltage ELVSS based on the reference luminance and the off-duty ratio.

For example, the power control unit 220 may calculate the reference luminance and the off-duty ratio based on the image data independently of the automatic current limit unit 210 and may generate the power voltage control signal based on the reference luminance and the off-duty ratio. For example, the power control unit 220 may calculate the reference luminance and the off-duty ratio based on the modulated image data dependently on the automatic current limit unit 210 and may generate the power voltage control signal based on the reference luminance and the off-duty ratio.

In an example embodiment, the power control unit 220 may calculate the on-pixel ratio of image data in a certain frame and may obtain the reference luminance and the off-duty ratio based on the on-pixel ratio. For example, the power control unit 220 may obtain the reference luminance and the off-duty ratio from a first look-up table. Here, the first look-up table may include the reference luminance and the off-duty ratio that are determined based on a luminance step (or, a luminance level) of the image data as described with reference to TABLE I.

In an example with reference to TABLE I, when a luminance step is 220 cd/m2 corresponding to a certain on-pixel ratio, the reference luminance may be 220 cd/m2 and the off-duty ratio may be 0%. In another example, when a luminance step is 120 cd/m2 corresponding to a certain on-pixel ratio, the reference luminance may be 220 cd/m2 and the off-duty ratio may be 40%. In the other example, when a luminance step is 30 cd/m2 corresponding to a certain on-pixel ratio, the reference luminance may be 100 cd/m2 and the off-duty ratio may be 70%.

In an example embodiment, the power control unit 220 may calculate a variable voltage difference between the first power voltage ELVDD and the second power voltage ELVSS based on the reference luminance, may determine whether the off-duty ratio is within a range (e.g., a predetermined range), and may select one from a reference voltage difference and the variable voltage difference based on the determination result. Here, the reference voltage difference may be a voltage difference between the power voltages (e.g., a first power voltage ELVDD and a second power voltage ELVSS) that are used in a conventional display device.

For example, the power control unit 220 may calculate the variable voltage difference corresponding to the reference luminance (i.e., a voltage difference between the first power voltage ELVDD and the second power voltage ELVSS to generate a driving current corresponding to the reference luminance). For example, the voltage controller 220 may calculate the variable voltage difference corresponding to the reference luminance by using a second look-up table. Here, the second look-up table may include information of the second power voltage ELVSS that is determined based on the reference luminance. For example, the power control unit 220 may select the variable voltage difference when the off-duty ratio is within the predetermined range. Here, the display device 100 may change the second power voltage ELVSS based on the variable voltage difference. For example, the power control unit 220 may select the reference voltage difference when the off-duty ratio is out of the predetermined range. In this case, the display device 100 may not change the second power voltage ELVSS based on the reference voltage difference.

As described above, when image data satisfies a condition (e.g., a predetermined condition), the signal controller 150 may generate the modulated image data by deducting the image data (e.g., performing an automatic current limit function), may calculate the reference luminance and the off-duty ratio based on the image data or the modulated image data, and may generate the power voltage control signal based on the reference luminance and the off-duty ratio. In addition, the signal controller 150 may alternatively use a function of changing the first power voltage ELVDD or the second power voltage ELVSS based on whether the off-duty ratio is within a range (e.g., a predetermined range). Therefore, the display device 100 may improve gamma characteristics in a certain luminance range (e.g., a low luminance range) as well as may reduce power consumption.

Figure 4:
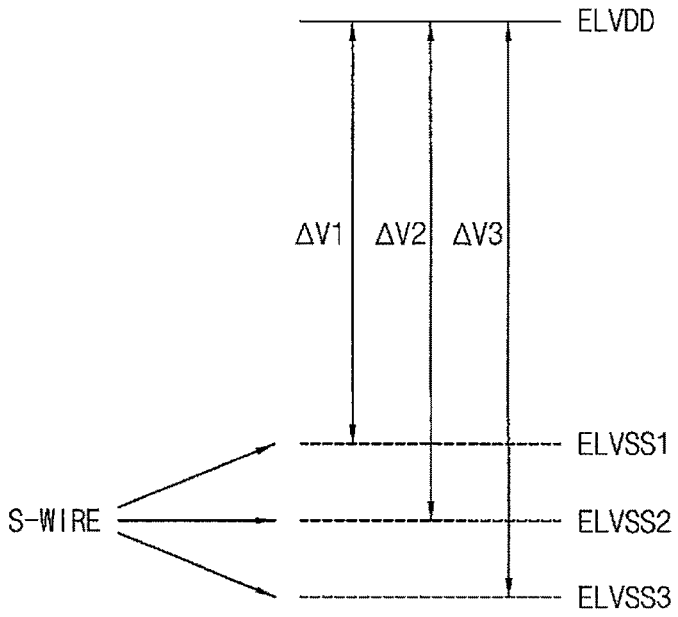
FIG. 4 is a diagram for describing an example of a power voltage control performed by a power supplier included in the display device of FIG. 1.

FIG. 4 is a diagram for explaining an example of a power voltage control performed by a power supplier included in the display device of FIG. 1.

Referring to FIG. 4, the power supplier 160 may control a level of the second power voltage ELVSS in response to the power voltage control signal S-wire. That is, the power supplier 160 may determine a level of the second power voltage ELVSS in response to the power voltage control signal S-wire. For example, the power supplier 160 may select one among pre-generated power voltages ELVSS1, ELVSS2, and ELVSS3 in response to the power voltage control signal S-wire. Here, a voltage difference between the first power voltage ELVDD and the second power voltage ELVSS may be ΔV1, ΔV2, or ΔV3.

Figure 5A:
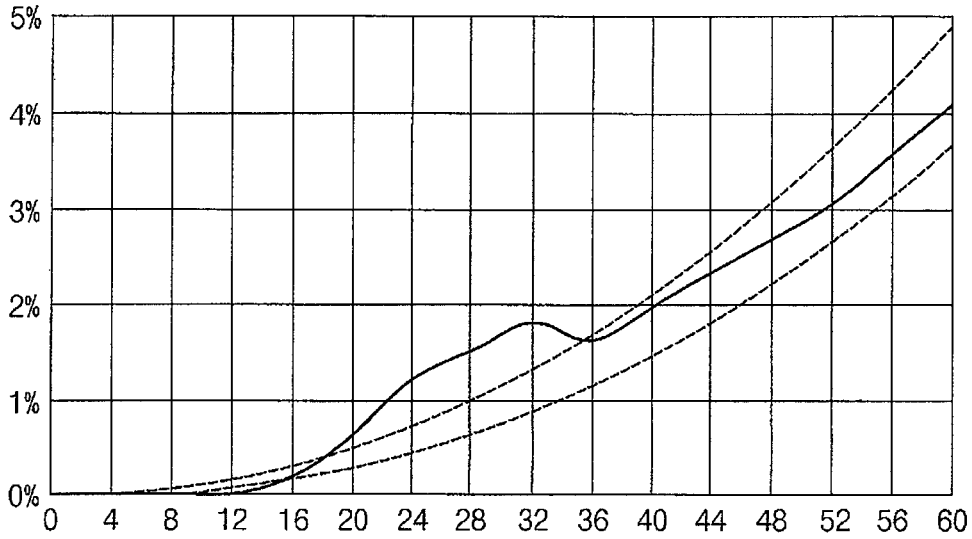
FIGS. 5A and 5B are graphs illustrating an example of a gamma graph of the display device of FIG. 1.
Figure 5B:
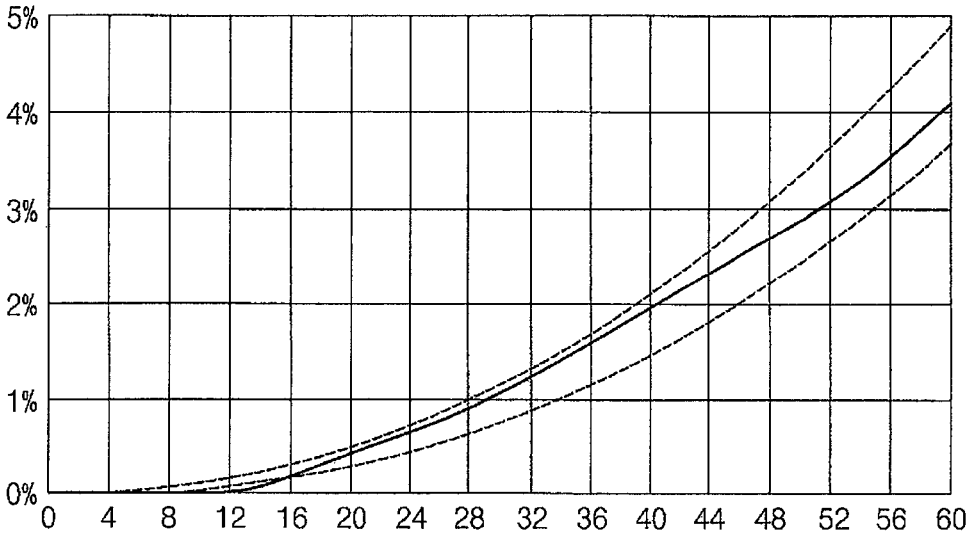

FIGS. 5A and 5B are graphs illustrating an example of a gamma graph of the display device of FIG. 1.

Referring to FIGS. 5A and 5B, an X-axis represents a grayscale of the image data, and a Y-axis represents luminance (percent (%)). FIGS. 5A and 5B show reference gamma curves and sensed gamma curves of the display device 100. Here, the reference gamma curves include a gamma curve 2.2 (e.g., a gamma curve having a gamma of 2.2) and a gamma curve 2.8 (e.g. a gamma curve having a gamma of 2.8). A first sensed gamma curve illustrated in FIG. 5A is a gamma curve of the display device 100 that controls a power voltage (e.g., the second power voltage ELVSS) based on only the reference luminance (e.g., not based on the off-duty ratio). A second sensed gamma curve illustrated in FIG. 5B is a gamma curve of the display device 100 that controls the power voltage (e.g., the second power voltage ELVSS) based on the reference luminance and the off-duty ratio.

In FIG. 5A, the first sensed gamma curve may be located between the gamma curve 2.2 and the gamma curve 2.8. In the first sensed gamma curve, luminance may increase as a grayscale increases.

However, as illustrated in FIG. 5A, a grayscale inversion phenomenon may occur in a low luminance range in which luminance is less than 40 nits (e.g., 32 nits through 40 nits). That is, luminance may decrease in spite of an increase of a grayscale in the low luminance range (e.g., 32 through 40).

In FIG. 5B, the second gamma curve may be located between the gamma curve 2.2 and the gamma curve 2.8. In the second sensed gamma curve, luminance may increase as a grayscale increases. No grayscale inversion phenomenon may occur in the second sensed gamma curve illustrated in FIG. 5B, in contrast to the first sensed gamma curve illustrated in FIG. 5A. That is, luminance may increase as a grayscale increases in the low luminance range less than 40 nits (e.g., 32 nits through 40 nits).

In brief, the display device 100 may control the voltage difference based on the reference luminance and the off-duty ratio of the image data. Thus, the display device 100 may improve gamma characteristics in the low luminance range.

Figure 6:
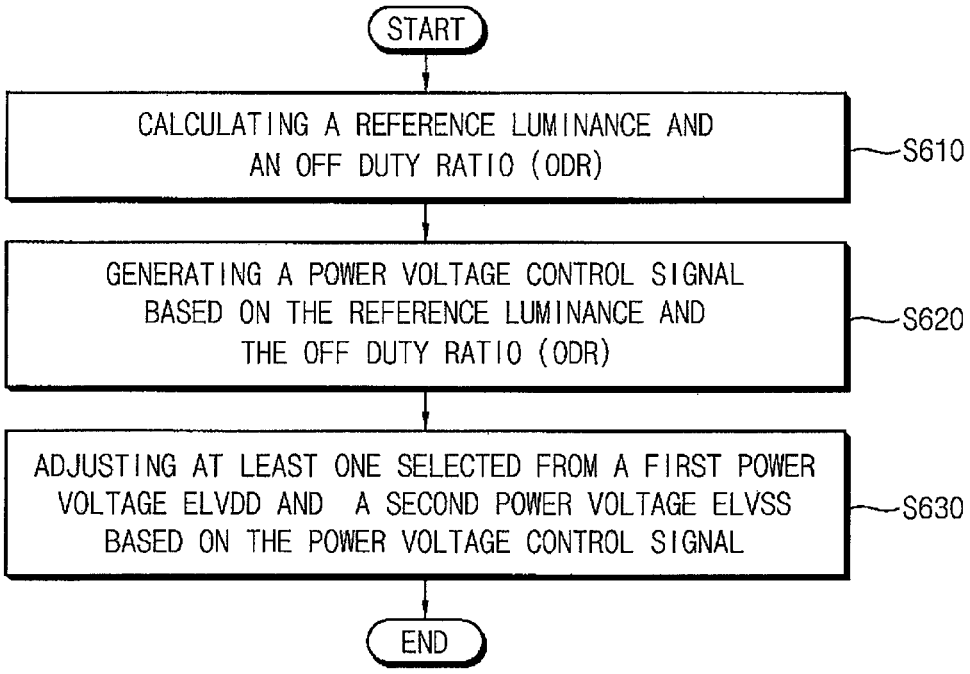
FIG. 6 is a flowchart illustrating a method of driving a display device according to some example embodiments of the present invention.

FIG. 6 is a flow chart illustrating a method of driving a display device according to some example embodiments of the present invention.

Referring to FIGS. 1 and 6, the method of FIG. 6 may drive the display device 100 of FIG. 1. The method of FIG. 6 may calculate the reference luminance and the off-duty ratio by analyzing image data in a specific frame (S610). As described with reference to FIG. 3, the method of FIG. 6 may calculate an on-pixel ratio of the image data and may obtain the reference luminance and the off-duty ratio based on the on-pixel ratio by using the first look-up table.

The method of FIG. 6 may generate the power voltage control signal to adjust at least one selected from the first power voltage ELVDD and the second power voltage ELVSS based on the reference luminance and the off-duty ratio (S620). As described with reference to FIG. 4, the method of FIG. 6 may calculate the variable voltage difference between the first power voltage ELVDD and the second power voltage ELVSS based on the reference luminance by using the second look-up table. In addition, the method of FIG. 6 may generate the power voltage control signal based on the variable voltage difference when the off-duty ratio satisfies a predetermined condition (e.g., based on whether the off-duty ratio is within 70%).

The method of FIG. 6 may adjust the first power voltage ELVDD and the second power voltage ELVSS based on the power voltage control signal (S630).

Figure 7:
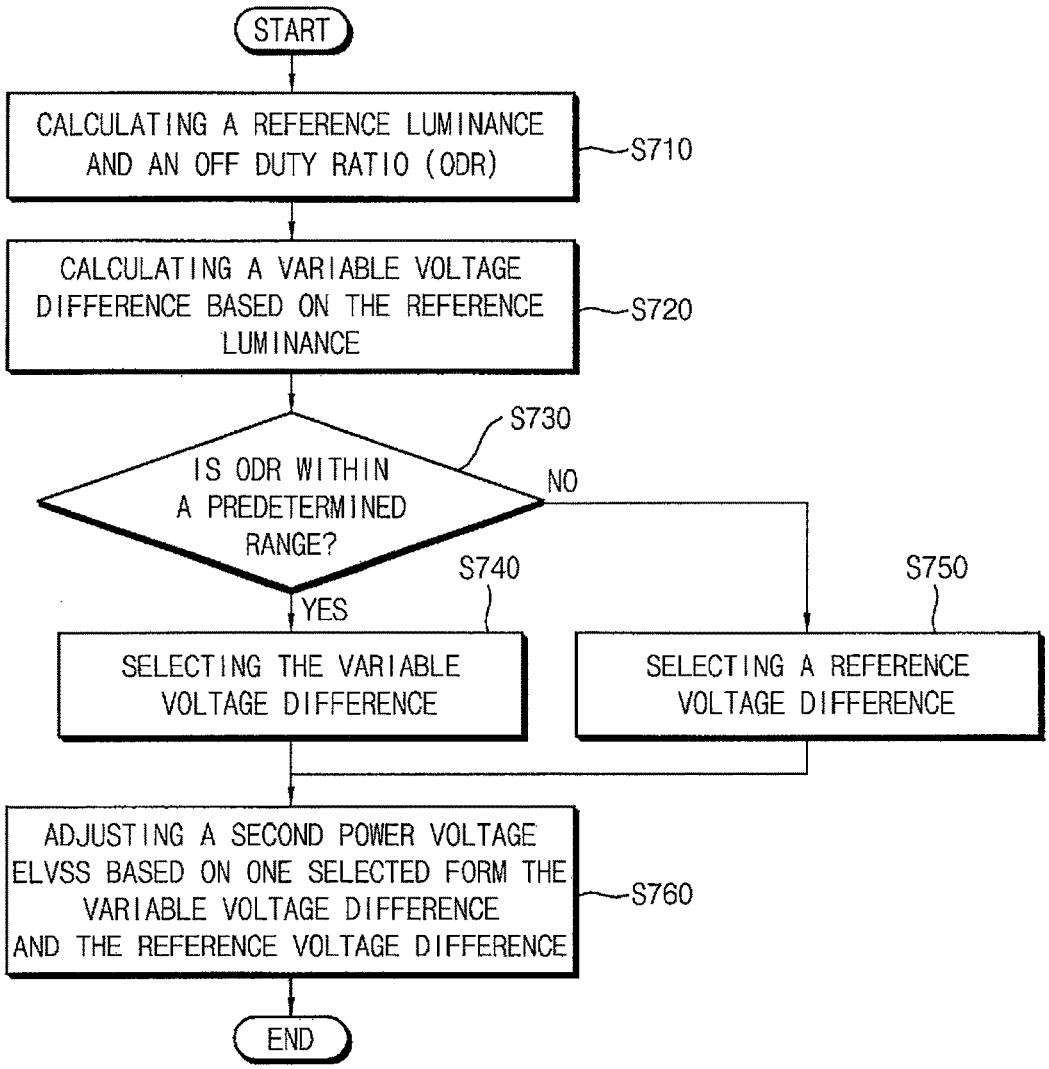
FIG. 7 is a flowchart illustrating a method of driving a display device according to some example embodiments of the present invention.

FIG. 7 is a flow chart illustrating a method of driving a display device according to example embodiments.

Referring to FIGS. 1 and 7, the method of FIG. 7 may calculate the reference luminance and the off-duty ratio by analyzing the image data (S710). For example, the method of FIG. 7 may calculate the reference luminance and the off-duty ratio based on the image data by using the first look-up table.

The method of FIG. 7 may calculate the variable voltage difference between the first power voltage ELVDD and the second power voltage ELVSS based on the reference luminance and the off-duty ratio (S720).

The method of FIG. 7 may determine whether the off-duty ratio is within a predetermined range (S730). For example, the method of FIG. 7 may determine whether the off-duty ratio is less than 70%. Here, the range (e.g., the predetermined range) may be set differently according to a set value for a smart dimming driving technique.

The method of FIG. 7 may select one from a reference voltage difference and the variable voltage difference based on the determination result. For example, the method of FIG. 7 may select the variable voltage difference from a reference voltage difference and the variable voltage difference when the off-duty is within the predetermined range (S740) (e.g., determining the variable voltage difference as a selected voltage difference). When the off-duty is out of the predetermined range, the method of FIG. 7 may select the reference voltage difference from the reference voltage difference and the variable voltage difference (S750) (e.g., determining the reference voltage difference as a selected voltage difference.

The method of FIG. 7 may generate the power voltage control signal based on the one selected from the reference voltage difference and the variable voltage difference (e.g., the selected voltage difference) and may adjust a level of the second power voltage ELVSS based on the power voltage control signal (S760). For example, when the method of FIG. 7 generates a first power voltage control signal, the method of FIG. 7 may change the second power voltage ELVSS based on the first power voltage control signal. For example, when the method of FIG. 7 generates a second power voltage control signal, the method of FIG. 7 may not change the second power voltage ELVSS but may generate the second power voltage ELVSS having a predetermined voltage level.

Figure 8:
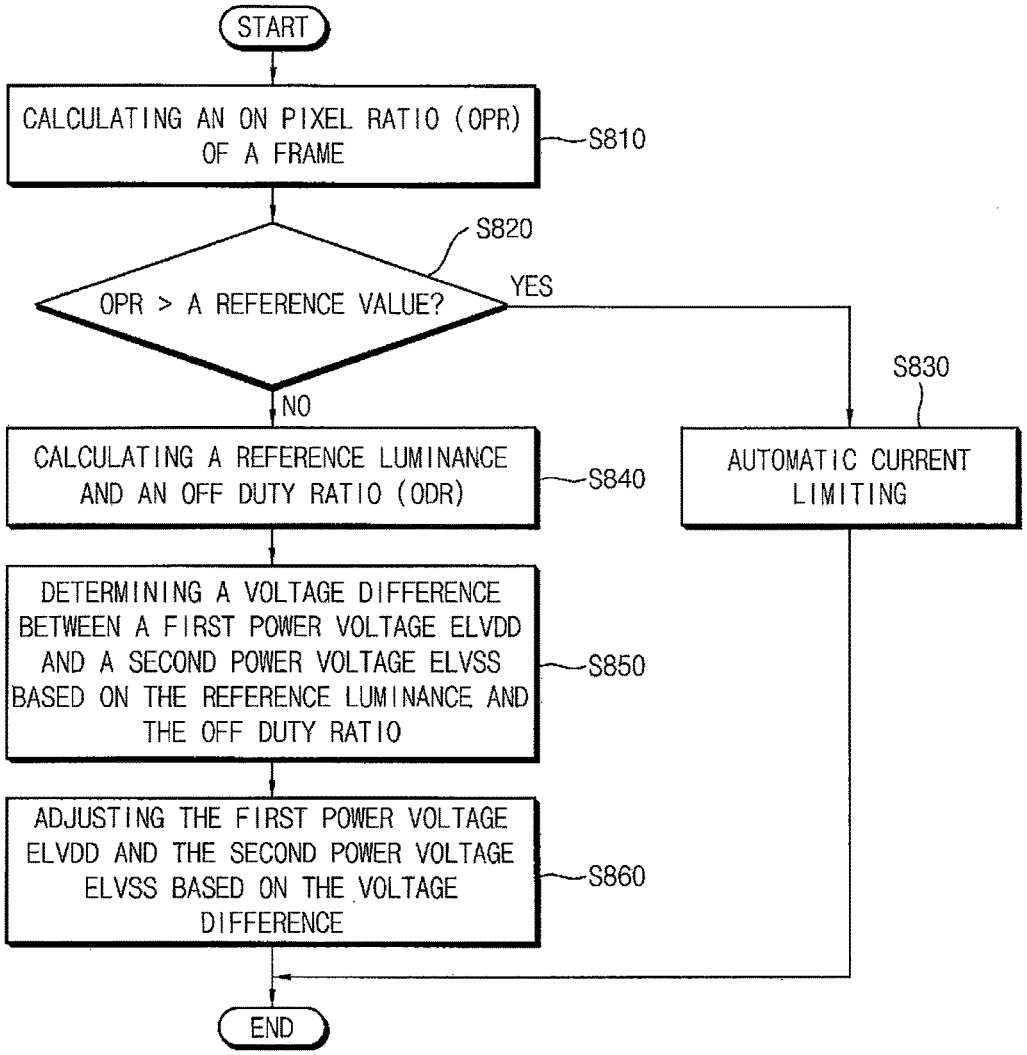
FIG. 8 is a flow chart illustrating a method of driving a display device according to some example embodiments of the present invention.

FIG. 8 is a flow chart illustrating a method of driving a display device according to example embodiments.

Referring to FIGS. 1 and 8, the method of FIG. 8 may calculate the on-pixel ratio based on image data in a certain frame (S810) and determine whether the on-pixel ratio exceeds a reference value (S820).

The method of FIG. 8 may determine whether or not to deduce the image data based on the on-pixel ratio of the image data. For example, if the on-pixel ratio exceeds the reference value, the method of FIG. 8 may generate modulated image data by reducing the image data with a specific ratio. For example, if the on-pixel ratio is lower than the reference value, the method of FIG. 8 may not deduct the image data or may include an operation of storing the image data as modulated image data.

The method of FIG. 8 may perform an automatic current limit function when the on-pixel ratio exceeds the reference value (S830). The method of FIG. 8 may not change a power voltage (e.g., the first power voltage ELVDD or the second power voltage ELVSS) supplied to the pixels 111.

When the on-pixel ratio is lower than the reference value, the method of FIG. 8 may calculate the reference luminance and the off-duty ratio based on the modulated image data (S840). As shown in FIG. 8, the method of FIG. 8 calculates the reference luminance and the off-duty ratio only when the on-pixel ratio is lower than the reference value. However, the method of FIG. 8 is not limited thereto. For example, when the on-pixel ratio exceeds the reference value, the method of FIG. 8 may include an operation of calculating the reference luminance and the off-duty ratio. Here, the method of FIG. 8 may be substantially the same as or similar to the methods of FIGS. 6 and 7.

The method of FIG. 8 may determine a voltage difference between the first power voltage ELVDD and the second power voltage ELVSS based on the reference luminance and the off-duty ratio (S850). For example, the method of FIG. 8 may calculate a variable voltage difference and determining whether to use the variable voltage difference for generating a power voltage (e.g., the second power voltage ELVSS) based on the off-duty ratio.

The method of FIG. 8 may adjust the first power voltage ELVDD and the second power voltage ELVSS based on the voltage difference (S860). The method of FIG. 8 may generate a power voltage control signal based on the voltage difference and may adjust the first power voltage ELVDD and the second power voltage ELVSS based on the power voltage control signal.

In brief, a method of driving a display device according to some example embodiments may limit the driving current of a pixel by deducting the image data or may change the power voltages supplied to the pixels. Thus, the method of driving the display device may reduce power consumption of the display device 100. In addition, the method of driving the display device may generate the off-duty ratio based on the image data and may alternatively use a power voltage control function based on the off-duty ratio. Thus, the method of driving the display device may prevent a gray-scale inversion phenomenon from occurring in some luminance ranges (e.g., a low luminance range), so that the method of driving the display device may improve gamma characteristics.

Aspects of embodiments of the present invention may be applied to any display device (e.g., an organic light emitting display device, a liquid crystal display device, etc) including a display panel. For example, aspects of embodiments of the present invention may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and aspects of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method of driving a display device, the method comprising:

receiving image data from an image data source;

determining the image data corresponds to a luminance range, from among a plurality of predetermined luminance ranges, other than a highest luminance range of the plurality of predetermined luminance ranges;

calculating a reference luminance corresponding to a light emission intensity and an off-duty ratio corresponding to a non-emission time based on the image data and the luminance range of the image data; and adjusting at least one selected from a first power voltage and a second power voltage to drive a display panel based on the reference luminance and the off-duty ratio, wherein adjusting the at least one selected from the first power voltage and the second power voltage comprises:

calculating a variable voltage difference between the first power voltage and the second power voltage based on the reference luminance;

determining whether or not the off-duty ratio is within a predetermined range;

selecting one from a reference voltage difference and the variable voltage difference based on a determination result; and generating a power voltage control signal based on the one from the reference voltage difference and the variable voltage difference.

2. The method of claim 1, wherein the off-duty ratio is an occupying ratio of the non-emission time in an emission period.

3. The method of claim 1, wherein the reference luminance is proportional to a luminance of the image data and is inversely proportional to an on-duty ratio of the image data, and wherein a sum of the on-duty ratio and the off-duty ratio is constant.

4. The method of claim 1, wherein calculating the reference luminance and the off-duty ratio comprises:

calculating an on-pixel ratio representing a ratio of a number of active pixels in an on-state to a total number of pixels in a unit frame; and obtaining the reference luminance and the off-duty ratio based on the on-pixel ratio.

5. The method of claim 4, wherein the reference luminance and the off-duty ratio are obtained from a first look-up table, and wherein the first look-up table comprises the reference luminance and the off-duty ratio that are determined based on a luminance level of the image data.

6. The method of claim 5, wherein the first look-up table comprises at least one range in which the off-duty ratio increases as the luminance level of the image data decreases.

7. The method of claim 1, wherein selecting the one from the reference voltage difference and the variable voltage difference comprises:

selecting the variable voltage difference in response to the off-duty ratio being within the predetermined range; and selecting the reference voltage difference in response to the off-duty ratio being out of the predetermined range.

8. The method of claim 1, wherein the variable voltage difference is obtained from a second look-up table, and wherein the second look-up table comprises an information of the second power voltage that is determined based on the reference luminance.

9. The method of claim 1, wherein adjusting the at least one selected from the first power voltage and the second power voltage further comprises:

adjusting a level of the second power voltage in response to the power voltage control signal.

10. A method of driving a display device, the method comprising:

receiving image data from an image data source;

determining the image data corresponds to a luminance range, from among a plurality of predetermined luminance ranges, other than a highest luminance range of the plurality of predetermined luminance ranges;

generating modulated image data by reducing a grayscale of the image data;

calculating a reference luminance corresponding to a light emission intensity and an off-duty ratio corresponding to a non-emission time based on the modulated image data; and adjusting at least one selected from a first power voltage and a second power voltage to drive a display panel based on the reference luminance and the off-duty ratio, wherein adjusting at least one selected from the first power voltage and the second power voltage comprises:

calculating a variable voltage difference between the first power voltage and the second power voltage based on the reference luminance;

determining whether or not the off-duty ratio is within a predetermined range;

selecting one from a reference voltage difference and the variable voltage difference based on a determination result; and generating a power voltage control signal based on the one from the reference voltage difference and the variable voltage difference.

11. The method of claim 10, wherein generating the modulated image data comprises:

calculating an on-pixel ratio representing a ratio of a number of active pixels in an on-state to a total number of pixels in a unit frame; and reducing the grayscale of the image data based on the on-pixel ratio.

12. The method of claim 11, wherein reducing the grayscale of the image data comprises:

determining whether or not the on-pixel ratio is out of a reference on-pixel ratio; and reducing the grayscale of the image data in proportion to the on-pixel ratio in response to the on-pixel ratio being out of the reference on-pixel ratio.

13. The method of claim 11, wherein calculating the reference luminance and the off-duty ratio comprises:

obtaining the reference luminance and the off-duty ratio based on the on-pixel ratio.

14. The method of claim 13, wherein the reference luminance and the off-duty ratio are obtained from a first look-up table, and wherein the first look-up table comprises the reference luminance and the off-duty ratio that are determined based on a luminance level of the modulated image data.

15. The method of claim 14, wherein the first look-up table comprises at least one range in which the off-duty ratio increases as the luminance level of the modulated image decreases.

16. The method of claim 10, wherein selecting the one from the reference voltage difference and the variable voltage difference comprises:

selecting the variable voltage difference in response to the off-duty ratio being within the predetermined range; and selecting the reference voltage difference in response to the off-duty ratio being out of the predetermined range.

17. The method of claim 10, wherein adjusting the at least one selected from the first power voltage and the second power voltage further comprises:

adjusting a level of the second power voltage in response to the power voltage control signal.

18. A display device comprising:

a display panel comprising a plurality of pixels;

a signal controller configured to:

receive image data from an image data source;

determine the image data corresponds to a luminance range, from among a plurality of predetermined luminance ranges, other than a highest luminance range of the plurality of predetermined luminance ranges;

calculate a reference luminance corresponding to a light emission intensity and an off-duty ratio corresponding to a non-emission time based on the image data and the luminance range of the image data; and generate a power voltage control signal based on the reference luminance and the off-duty ratio; and a power supplier configured to adjust at least one selected from a first power voltage and a second power voltage to drive the display panel in response to the power voltage control signal, wherein the at least one selected from the first power voltage and the second power voltage is adjusted by calculating a variable voltage difference between the first power voltage and the second power voltage based on the reference luminance, by determining whether or not the off-duty ratio is within a predetermined range, by selecting one from a reference voltage difference and the variable voltage difference based on a determination result, and by generating the power voltage control signal based on the one from the reference voltage difference and the variable voltage difference.

* * * * *